US011306591B2

(12) United States Patent
Sleiman et al.

(10) Patent No.: US 11,306,591 B2
(45) Date of Patent: Apr. 19, 2022

(54) ROTARY DEVICE

(71) Applicant: Vengeance Power Inc., Tecumseh (CA)

(72) Inventors: Tony Sleiman, Windsor (CA); Andre Sarkis Laba, Windsor (CA); Jessie Joseph Laba, Tecumseh (CA); Buck Sleiman, Tecumseh (CA)

(73) Assignee: Vengeance Power Inc.

( * ) Notice: Subject to any disclaimer, the term of this patent is extended or adjusted under 35 U.S.C. 154(b) by 50 days.

(21) Appl. No.: 16/564,888

(22) Filed: Sep. 9, 2019

(65) Prior Publication Data

US 2020/0080421 A1 Mar. 12, 2020

Related U.S. Application Data

(60) Provisional application No. 62/729,083, filed on Sep. 10, 2018.

(51) Int. Cl.

| | |
|---|---|
| ***F01C 21/08*** | (2006.01) |
| ***F01C 1/44*** | (2006.01) |
| ***F01C 19/02*** | (2006.01) |

(52) U.S. Cl.

CPC ..... *F01C 21/0881* (2013.01); *F01C 21/0836* (2013.01); *F01C 1/44* (2013.01); *F01C 19/02* (2013.01)

(58) Field of Classification Search

CPC .. F01C 21/0881; F01C 21/0836; F01C 19/02; F01C 1/44; F01C 21/0845

See application file for complete search history.

(56) References Cited

U.S. PATENT DOCUMENTS 805,163 A * 11/1905 Smith ..... F01C 1/44 418/263
2,345,561 A * 4/1944 Allen, Jr. ..... F01C 1/3446 418/148

(Continued)

FOREIGN PATENT DOCUMENTS

EP 1852576 A2 * 11/2007 ..... F02B 57/10

OTHER PUBLICATIONS

EP1852576 translation (Year: 2021).*
Centrifugal force—Wikipedia pdf from en.wikipedia.org/wiki/Centrifugal_force (Year: 2021).*

*Primary Examiner* — Kenneth J Hansen
*Assistant Examiner* — David N Brandt
(74) *Attorney, Agent, or Firm* — Taylor English Duma LLP

(57) ABSTRACT

A rotor can comprise a body having arcuate voids each presenting away from a rotation axis and, for each void, a vane. The vane is mounted to the body for pivotal movement between retracted and extended positions; is adapted to sweep the void in the manner in which a piston sweeps a cylinder during movement between the positions; and terminates in a tip. A stator defines the rotation axis; and has an annular surface which, in use, is swept by the tips during rotation of the body. The surface is positioned such that, in each rotation, each vane cycles between its extended and retracted positions. A sealing arrangement defines a pair of ports and, in combination with the rotor and stator, defines, in use, chambers that increase in volume when in communication with one of the ports and that decrease in volume when in communication with the other of the ports.

3 Claims, 8 Drawing Sheets

(56) References Cited

U.S. PATENT DOCUMENTS

2003/0131723 A1* 7/2003 Al Hawaj ..... F01B 15/002
91/472
2005/0053509 A1* 3/2005 Liposcak ..... F04C 2/44
418/268

* cited by examiner

ROTARY DEVICE

CROSS-REFERENCE TO RELATED APPLICATIONS

The present application claims the benefit of U.S. Provisional Application No. 62/729,083, filed Sep. 10, 2018, which is hereby specifically incorporated by reference herein in its entirety.

FIELD

The invention relates to the field of rotary vane pumps and engines.

BACKGROUND

Rotary vane pumps and engines are well known but devices that have good performance can often be difficult to manufacture and overhaul.

SUMMARY OF THE INVENTION

Forming one aspect of the invention is apparatus comprising a rotor, a stator and a sealing arrangement.

The rotor, in use, rotates about a rotation axis, and has: a body having defined therein a plurality of arcuate voids each presenting away from the rotation axis; and for each of the voids of the plurality, a vane, the vane: being pivotally mounted to the body for movement between a retracted position and an extended position; being adapted to sweep the void in the manner in which a piston sweeps a cylinder during movement between the retracted and extended positions; and terminating in a tip;

The stator: defines the rotation axis; and has an annular surface which, in use, is swept by the tips of the vanes during rotation of the body, the annular surface being positioned such that, in each rotation, each vane makes a cycle between the extended position and the retracted position thereof.

The sealing arrangement defines a pair of ports and is adapted, in combination with the rotor and the stator, to define, in use, chambers that increase in volume when in communication with one of the pair of ports and that decrease in volume when in communication with the other of the pair of ports.

According to another aspect, a roller bearing can be provided for and define each tip.

According to another aspect, the vanes can be urged to the extended position by centrifugal force.

According to another aspect, a hinge bearing can be provided for each vane and mounts said each vane to the body.

According to another aspect, the sealing arrangement can define a pair of tracks, spaced apart from one another in the direction of the rotation axis; and each vane has, in each of the tracks, a follower.

According to another aspect, the follower can be a roller mounted for rotation relative to the vane about an axis parallel to the rotation axis.

According to another aspect, the follower can be a cam follower.

Other advantages, features and characteristics of the invention will become apparent upon review of the following detailed description with reference to the appended drawings, the latter being briefly described hereinafter.

DETAILED DESCRIPTION

Figure 1:
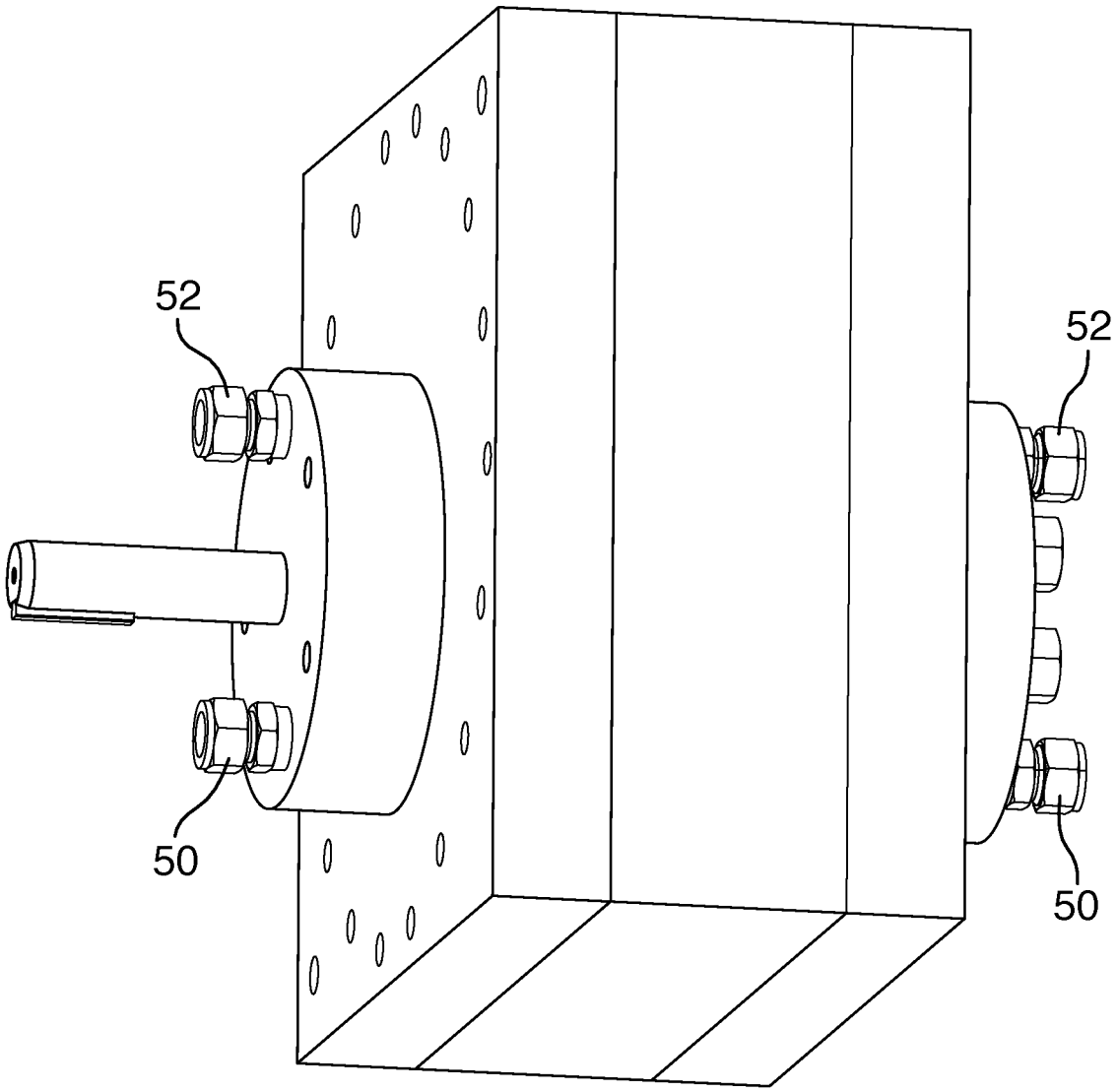
FIG. 1 is a perspective view of apparatus according to an embodiment of the invention.
Figure 2:
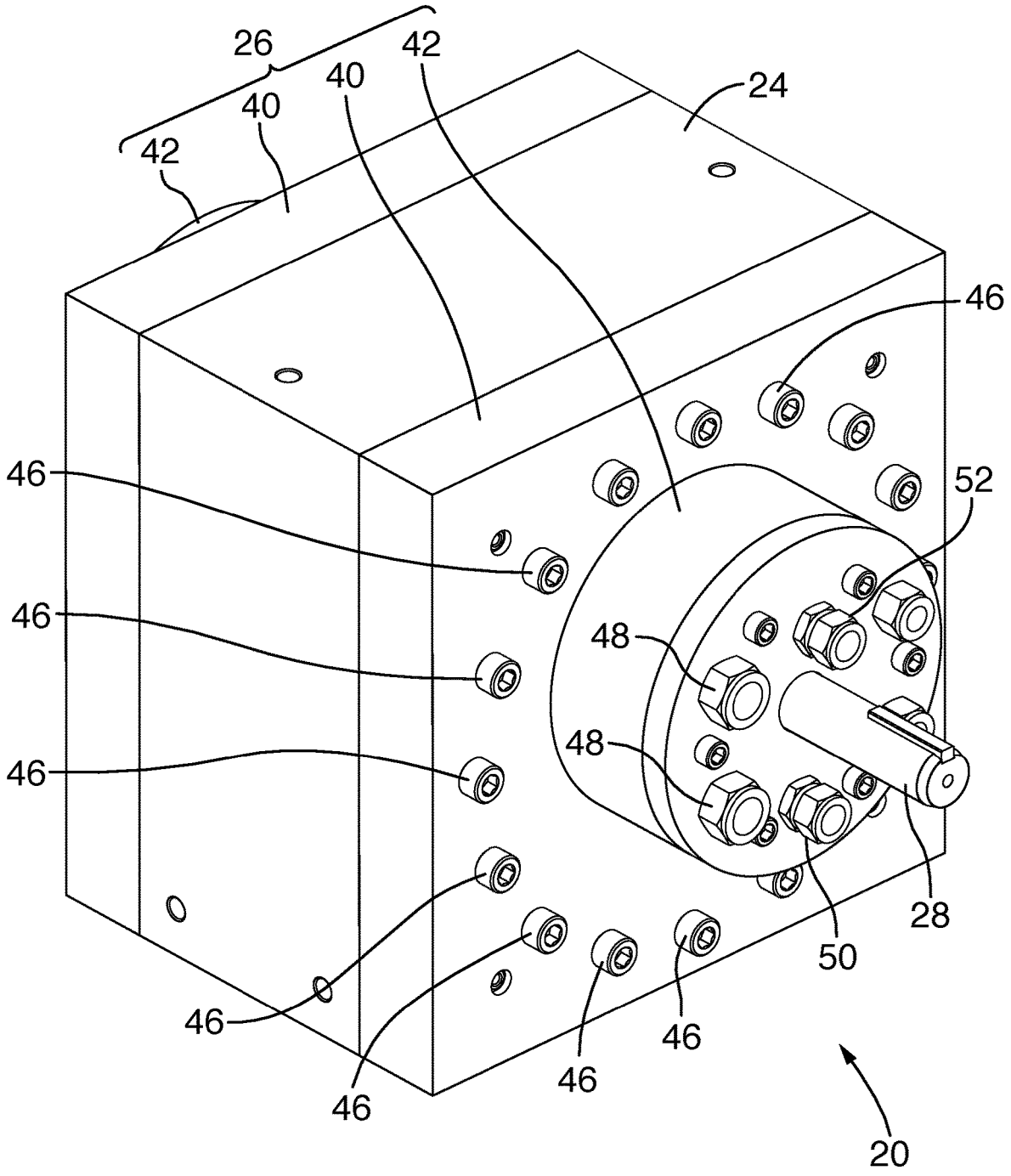
FIG. 2 is another perspective view of the structure of FIG. 1.
Figure 3:
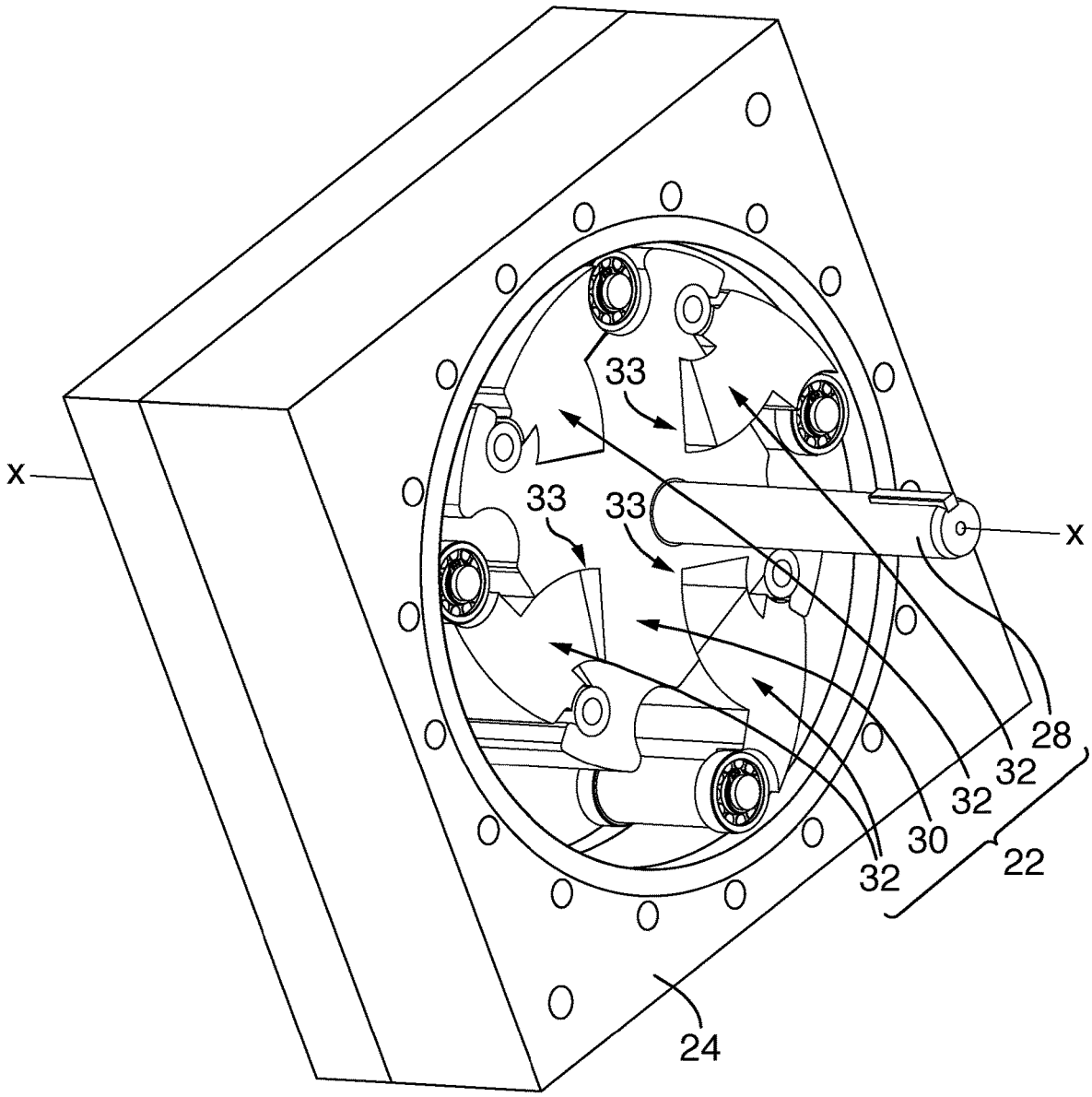
FIG. 3 is a view of the structure of FIG. 1 with a portion removed.
Figure 4:
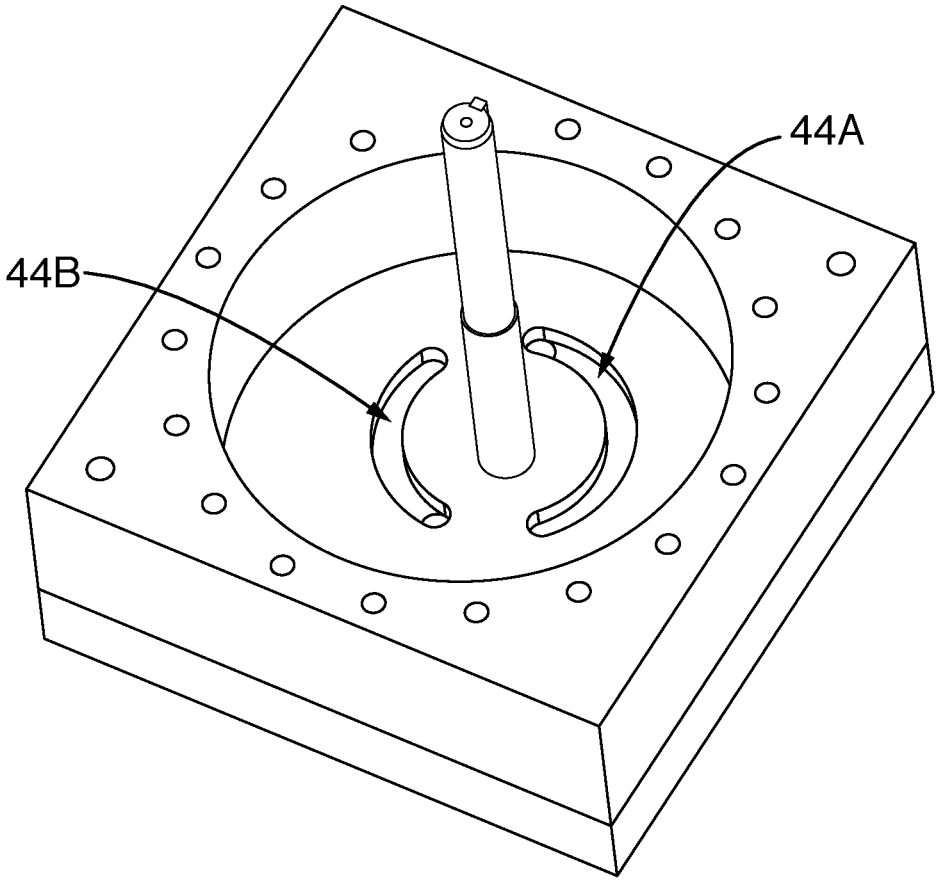
FIG. 4 is a view of the structure of FIG. 3 with a further portion removed.
Figure 5:
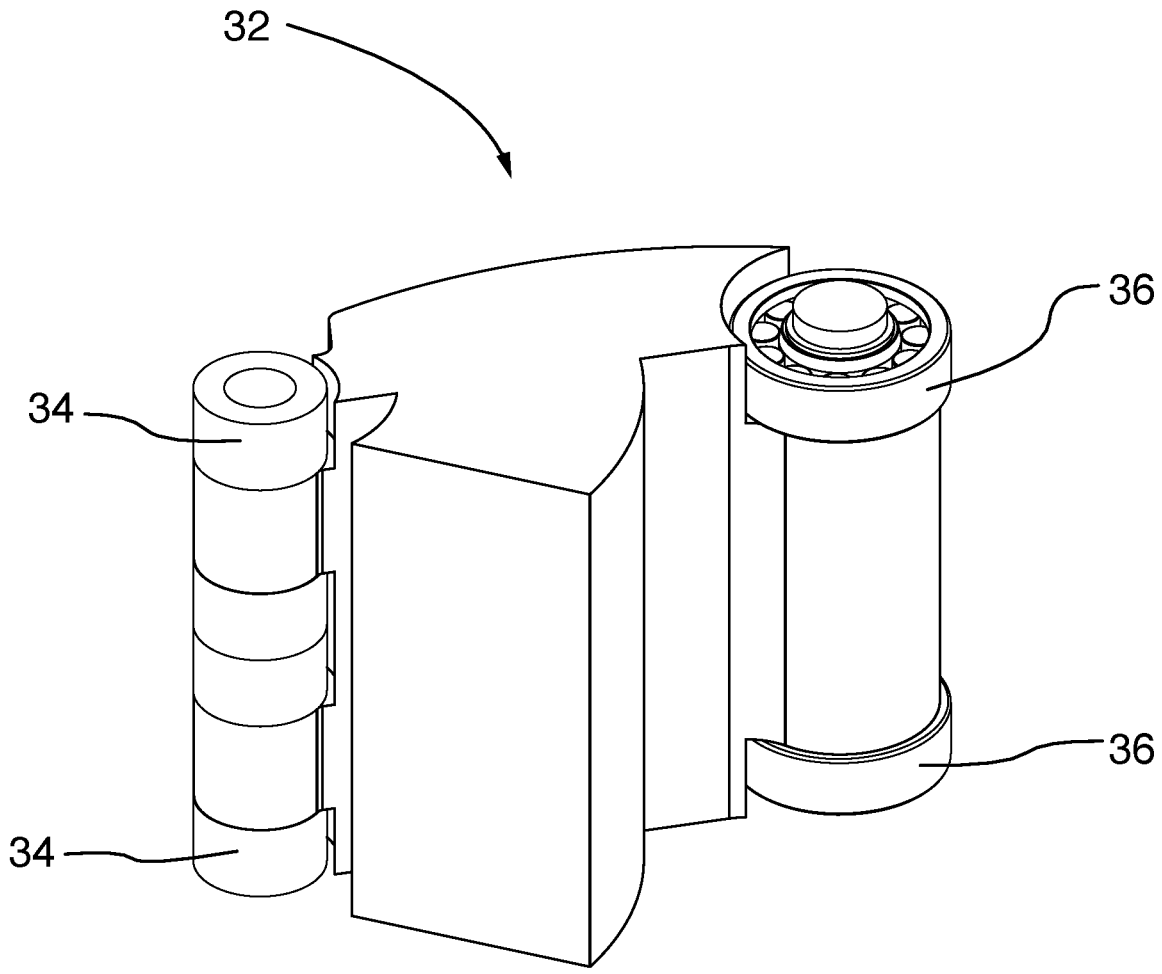
FIG. 5 is a view of a portion of the structure of FIG. 3.
Figure 6:
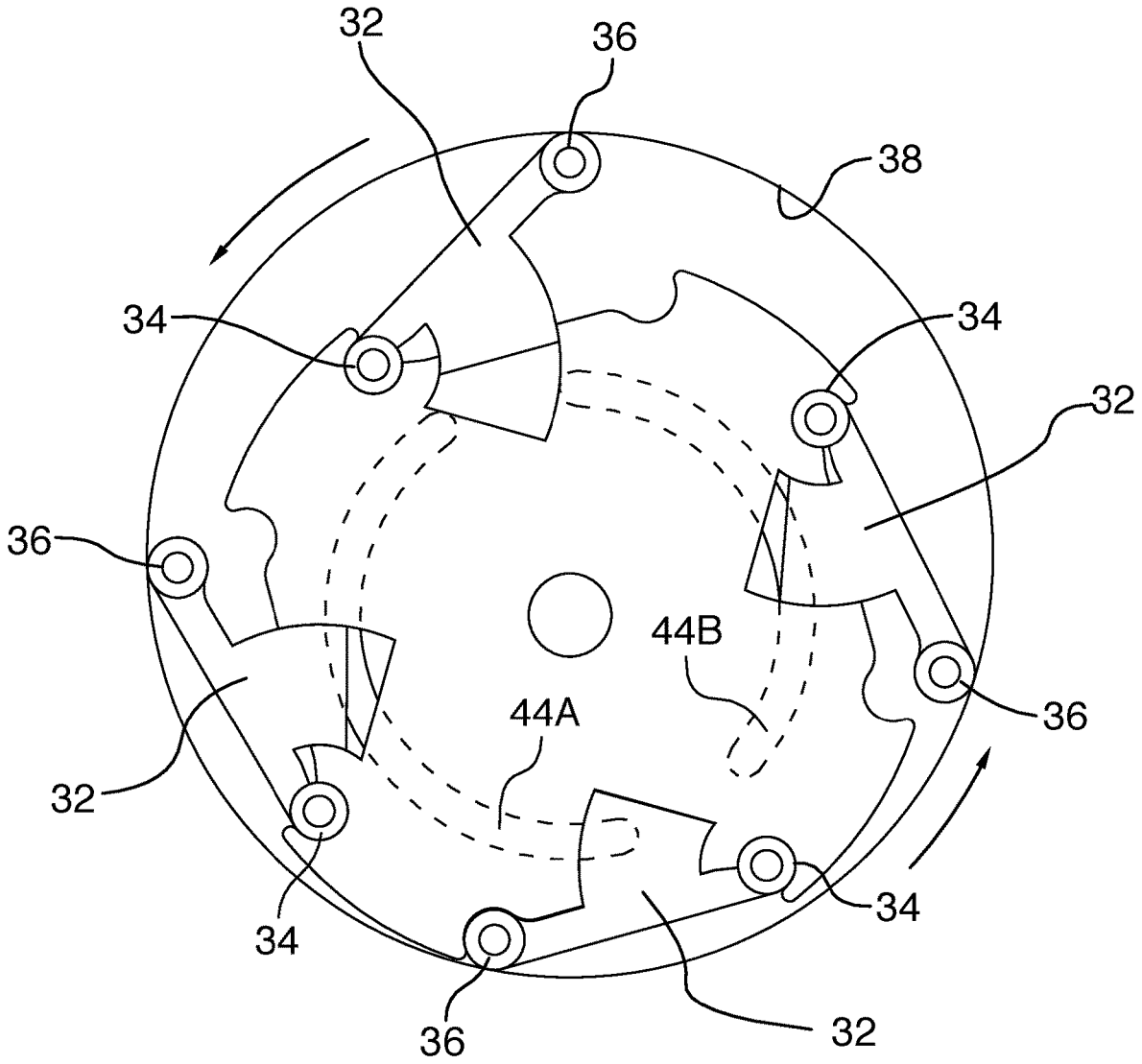
FIG. 6 is a partially schematic view of the structure in use.

Apparatus 20 according to an exemplary embodiment of the invention is shown in the drawings and will be seen to include a rotor 22, a stator 24 and a sealing arrangement 26.

The rotor 22 has a shaft 28, a body 30 and a plurality of vanes 32. The shaft 28 defines a rotation axis X-X. The body 30 is mounted to the shaft and defines a plurality of arcuate voids 33, each void 33 presenting generally away from the rotation axis. Each vane is pivotally mounted to the body by a hinge bearing 34 and terminates in a roller bearing 36.

The stator defines an annular surface 38 in which the rotor is positioned.

The sealing arrangement comprises a pair of end plates 40 and a pair of bearing plates 42. The end plates each define a pair of arcuate slots 44A, 44B and are disposed on opposite sides of the stator and secured thereto by bolts 46. The bearing plates are secured to the end plates by bolts 48 such that the end plates are disposed therebetween and support the shaft for rotational movement. Each bearing plate has a pair of ports 50,52, each communicating with one of the arcuate slots of the end plate to which it is secured.

In use, the rotor body is rotated by the shaft at a speed such that centrifugal force causes the tips to sweep the annular surface, the annular surface being offset relative to the rotation axis such that, in each rotation, the vanes are cycled between extended and retracted positions, sweeping the voids in the manner in which a piston sweeps a cylinder and, in combination with the end plates, defining chambers that increase in volume when in communication with slots 44B and that decrease in volume when in communication with slots 44A.

Persons of ordinary skill will readily appreciate that the structure has significant utility in use in that it, inter alia: can be manufactured at relatively low cost; is relatively easy to assemble and overhaul; is reversible; can be used with variable speed drives; can be embodied with varied numbers of pistons; can run with or without seals; can run with or without oil lubrication.

Figure 7:
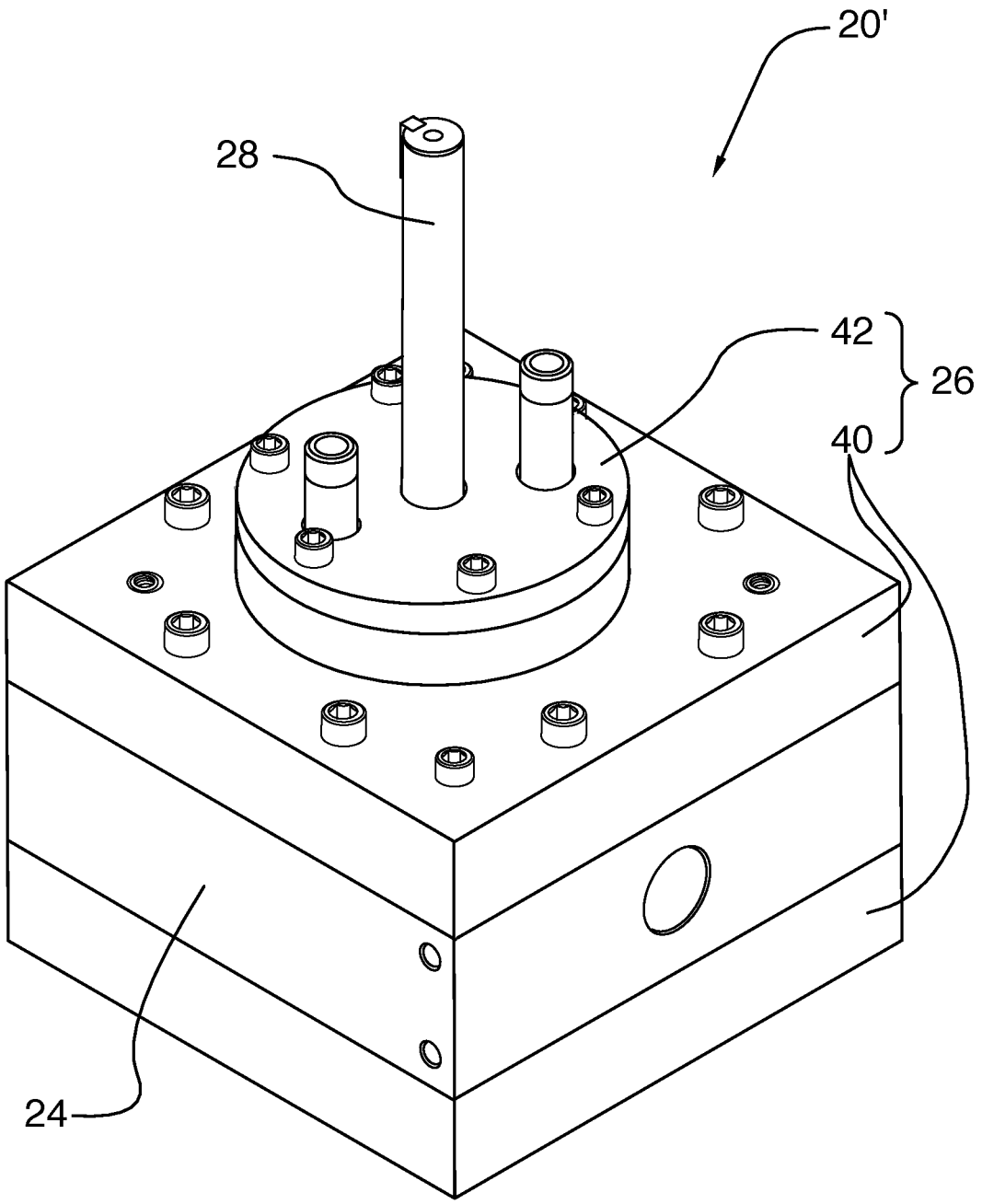
FIG. 7 is a perspective view of apparatus according to another embodiment of the invention.
Figure 8:
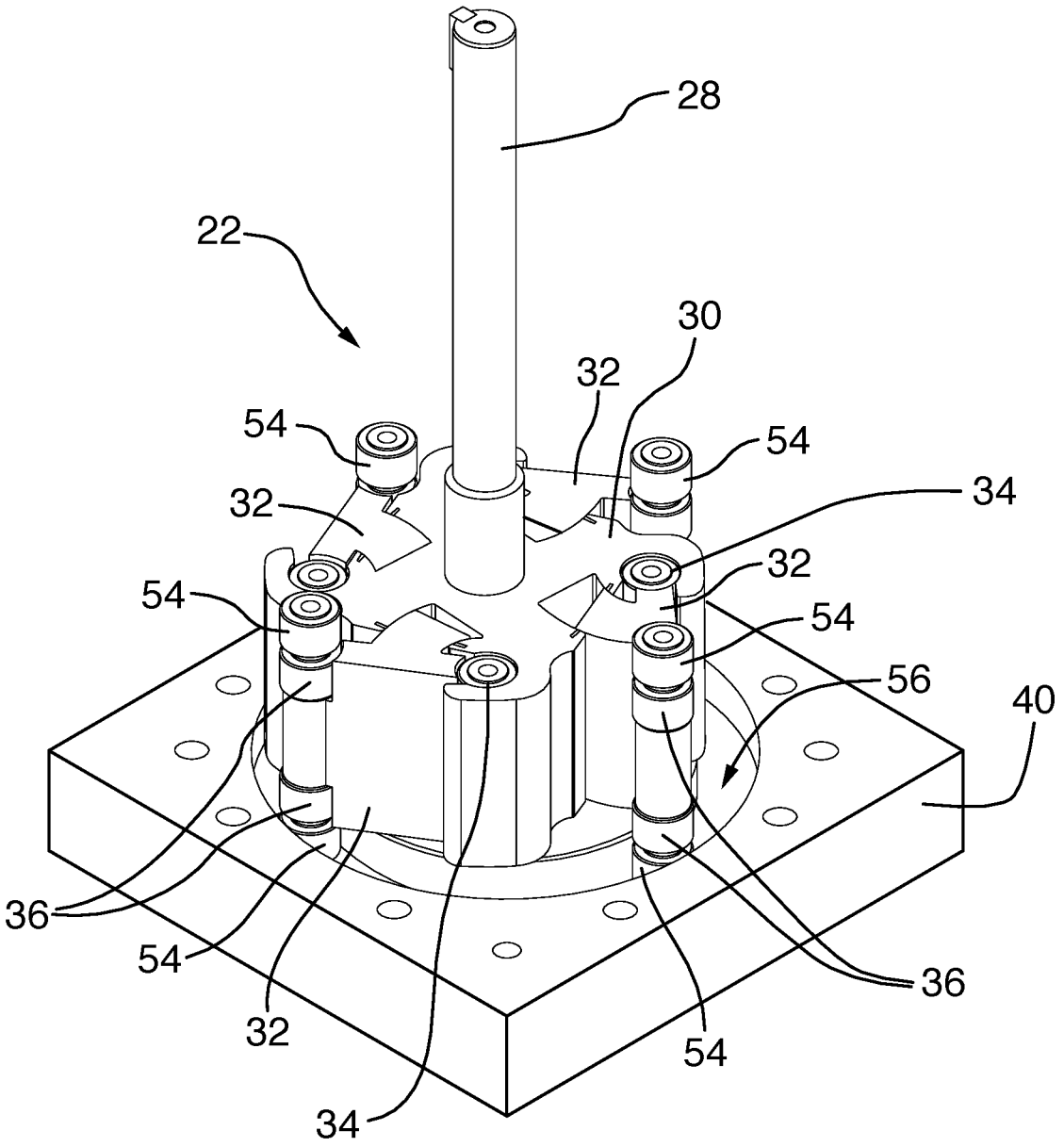
FIG. 8 is a view of the structure of FIG. 7 with portions removed.

A further embodiment is shown in FIG. 7. This apparatus operates similarly to that shown in FIG. 1-6—and, as shown, with similar structures as described above—but whereas in the embodiment of FIG. 1-6 vane outward sweep is dependent entirely upon centrifugal force, herein, each vane 32 is provided with a pair of followers 54, specifically rollers, and each end plate has a track 56 in which the followers travel, the track being shaped such that, as the rollers traverse therealong, the vanes follow the motion previously described even at slow speeds and when relatively viscous fluids are used.

Further variations are possible.

For example, magnets or springs could also be used to urge the vanes against the annular surface.

Accordingly, the invention should be understood to be limited only by the accompanying claims, purposively construed.

The invention claimed is:

1. An apparatus comprising:

a rotor which, in use, is configured to rotate about a rotation axis, the rotor comprising:

a body having defined therein a plurality of arcuate voids each presenting away from the rotation axis; and a plurality of vanes, each vane of the plurality of vanes corresponding to a void of the plurality of voids, and each vane of the plurality of vanes adapted to:

be pivotally mounted to the body for movement between a retracted position and an extended position;

move within the void between the retracted and extended positions; and terminate in a tip;

wherein each vane of the plurality of vanes comprises a roller bearing, the roller bearing of each vane of the plurality of vanes defining the corresponding tip;

a stator: defining the rotation axis; and having an annular surface which, in use, is swept by the tips of the vanes during rotation of the body, the annular surface being positioned such that, in each rotation, each vane makes a cycle between the extended position and the retracted position thereof;

a sealing arrangement defining a pair of ports and adapted, in combination with the rotor and the stator, to define, in use, chambers that increase in volume when in communication with one port of the pair of ports and that decrease in volume when in communication with an other port of the pair of ports, the sealing arrangement further defining a pair of tracks, the pair of tracks spaced apart from one another in a direction of the rotation axis, a follower of each vane of the plurality of vanes positioned in each track of the pair of tracks, the follower being a roller mounted for rotation relative to the corresponding vane of the plurality of vanes about an axis parallel to the rotation axis, wherein the axis of the follower is coincident with an axis of the roller bearing that defines the tip.

2. The apparatus according to claim 1, wherein the vanes are urged to the extended position by centrifugal force while in use.

3. The apparatus according to claim 1, wherein a hinge bearing is provided for each vane of the plurality of vanes, the hinge bearing mounting the corresponding vane of the plurality of vanes to the body.

* * * * *